US005927855A

United States Patent [19]

Tomic et al.

[11] Patent Number: 5,927,855

[45] Date of Patent: Jul. 27, 1999

[54] TAMPER-EVIDENT CLOSURE ARRANGEMENTS AND METHODS

[75] Inventors: Mladomir Tomic; Michael E. Schreiter, both of Appleton, Wis.

[73] Assignee: Reynolds Consumer Products, Inc., Appleton, Wis.

[21] Appl. No.: 09/107,945

[22] Filed: Jun. 30, 1998

[51] Int. Cl.[6] ..... B65D 33/30; B65D 33/34

[52] U.S. Cl. ..... 383/5; 383/63; 383/211; 383/93; 493/214

[58] Field of Search ..... 383/5, 63, 65, 383/210, 211, 93; 493/214

[56] References Cited

U.S. PATENT DOCUMENTS

| | | | |
|---|---|---|---|
| 3,338,284 | 8/1967 | Ausnit . | |
| 3,780,781 | 12/1973 | Uramoto . | |
| 4,615,045 | 9/1986 | Siegel . | |
| 4,791,710 | 12/1988 | Nocek et al. | 383/5 |
| 4,947,525 | 8/1990 | Van Erden | 383/63 |
| 4,964,739 | 10/1990 | Branson et al. . | |
| 5,185,909 | 2/1993 | Inagaki . | |
| 5,188,461 | 2/1993 | Sorensen . | |
| 5,474,382 | 12/1995 | May | 383/63 |
| 5,603,995 | 2/1997 | Takubo et al. | 383/63 |

*Primary Examiner*—Stephen P. Garbe
*Attorney, Agent, or Firm*—Alan M. Biddison

[57] ABSTRACT

A tamper evident package includes a closure arrangement having a lockable orientation and an unlockable orientation. The lockable orientation includes a first closure member secured to a first package wall, and a second closure member secured to a second package wall. Preferably, the first closure member is secured to the first wall with a peelable sealing arrangement. The unlockable orientation includes the first closure member being separated or peeled from the first wall. The closure arrangement is transformed from the lockable orientation to the unlockable orientation in response to a pulling force separating the first closure member from the first wall. In some arrangements, the peelable sealing arrangement is pigmented to provide a visual indication that the package has been opened after an initial sealing of the closure arrangement. Methods for constructing and using a flexible package are provided herein.

20 Claims, 2 Drawing Sheets

TAMPER-EVIDENT CLOSURE ARRANGEMENTS AND METHODS

FIELD OF THE INVENTION

The present invention generally relates to closure arrangements for polymeric packages. In particular, the present invention relates to tamper-evident closures.

BACKGROUND OF THE INVENTION

Many packaging applications use containers with zipper-type closure arrangements to store various types of articles and materials. These packages may be used to store and ship non-food consumer goods, food products, medical supplies, waste materials, and many other articles.

Concerns are sometimes raised with respect to reclosable zipper-type closure arrangements. These concerns relate to the fact that in many zipper-type closure arrangements, it is not evident that the package has been opened. This may lead to product-tampering and other problems. In addition, in certain instances, it may be desirable to be able to quickly and manually seal a package and still be able to detect whether the package has been unsealed after the initial sealing.

SUMMARY OF THE INVENTION

The disclosure herein describes tamper-evident closure arrangements. By "tamper-evident", it is meant that, after initial sealing of the package, there is no way to access the package interior without damaging the closure arrangement or the package. In certain embodiments, the closure arrangement is a zipper-type closure, which allows for quick, manual sealing of a package. After initial sealing, if access is gained to the package interior, the arrangements herein provide evidence of that access.

In one embodiment, a flexible package includes first and second film walls defining an interior and a mouth. A closure arrangement is provided for moving the mouth from an open position, where access is provided to the package interior, to a closed position, which blocks access to the package interior. The closure arrangement has a lockable orientation and an unlockable orientation. The lockable orientation includes the first closure member secured to the first wall, and a second closure member secured to the second wall. The first and second closure members each have a profile constructed and arranged to selectively interlock. The unlockable orientation of the closure arrangement includes the first closure member being separated from the first wall. The closure arrangement is transformed from the lockable orientation to the unlockable orientation responsive to a pulling force separating the first closure member from the first wall.

Preferably, the first closure member is secured to the first wall by a peelable sealing arrangement. In certain embodiments, the peelable sealing arrangement has a peelable sealant layer that is a color which contrasts with other portions of the closure arrangement.

In certain aspects, the invention is directed to a method of constructing a flexible package. The method includes steps of providing a first film wall and providing a second film wall. The method also includes securing with a peelable sealant arrangement a first closure member to the first wall, and securing a second closure member to the second wall. The first and second closure members include first and second profiles which are constructed and arranged to selectively interlock with a first bond strength. Preferably, the step of securing with a peelable sealing arrangement includes securing the first closure with a peelable seal layer having a second bond strength. Preferably, the second bond strength is less than the first bond strength between the interlocking first and second profiles.

In other aspects, a method is provided for using a flexible package. The method comprises steps of providing a flexible package having an interior, a mouth providing access to the interior, and a closure arrangement. The closure arrangement includes a first closure member secured to a first wall of the flexible package, and a second closure member secured to an opposite, second wall of the flexible package. The method also preferably includes sealing the mouth in a closed position to block access to the interior by interlocking the first and second closure members, and accessing the package interior by pealing the first closure member away from the first wall.

Some methods for using a flexible package preferably use constructions as described herein.

The above summary of the inventions is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
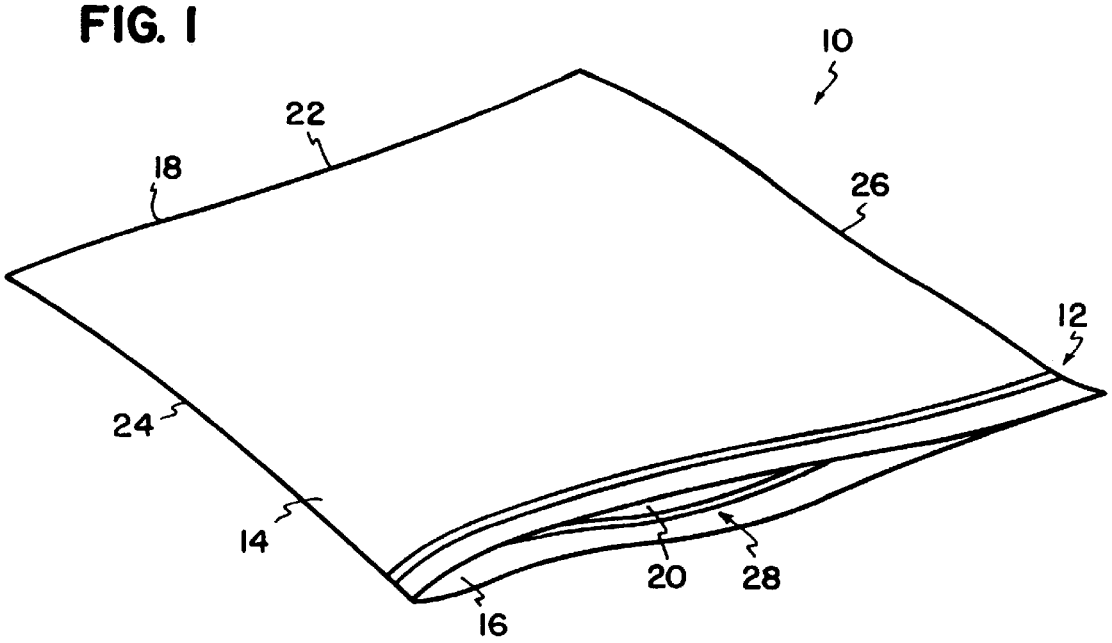
FIG. 1 is a perspective view of a flexible package according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

The present invention is believed to be applicable to a variety of packaging arrangements. The invention has been found to be particularly advantageous for use in sealing mechanisms for polymeric packages. An appreciation of various aspects of the invention is best gained through a discussion of an application example for such a packaging arrangement.

According to an example embodiment of the present invention, a package includes a closure arrangement to allow for quick, manual closure and sealing of a package, while providing a way for checking whether the package has been opened after the initial sealing. FIG. 1 illustrates an example type of package 10 that benefits from use of such a closure arrangement.

FIG. 1 illustrates an example packaging arrangement in the form of a flexible package 10 having a closure mechanism 12 constructed in accordance with the present invention. The flexible package 10 includes first and second opposed panel sections 14, 16 made from a flexible, polymeric film. For some manufacturing applications, the first and second panel sections 14, 16 are heat-sealed together along two edges 24, 26 and meet at a fold line 18 in order to form a 3-edged containment section for a product within an interior 20 of the package 10. The fold line 18 comprises a product-supporting bottom or bottom edge 22, depending on the orientation which the package 10 is held. Alternatively, two separate panel sections 14, 16 of polymeric film may be used and heat-sealed together along two opposite edges 24, 26 and along edge 22. Access is provided to the interior 20 of the package 10 through a mouth 28.

Package 10 includes a product side and a consumer side. As used herein, the term "product side" refers to the volume inside of the package 10 between the closure mechanism 12 and the edges 22, 24, and 26. The "consumer side" refers to a side opposite of the product side, and is the region of the package 10 accessible by the user when the closure mechanism 12 is in a closed or sealed orientation.

The flexible package 10 may be used to hold a variety of products. Such products may include groceries, edible food products, clothing, and other articles.

Closure mechanism 12 is illustrated in FIG. 1 at the mouth 28 of the flexible package 10. Each closure mechanism 12 extends the width of the package 10. In one particular embodiment illustrated in FIGS. 2–4, the closure mechanism 12 of FIG. 1 is shown in the specific form of a zipper-type mechanism 30. By the term "zipper-type mechanism", it is meant a structure having oppositely disposed interlocking or mating profiles, which under the application of pressure, will interlock and block access between the profiles.

Figure 2:
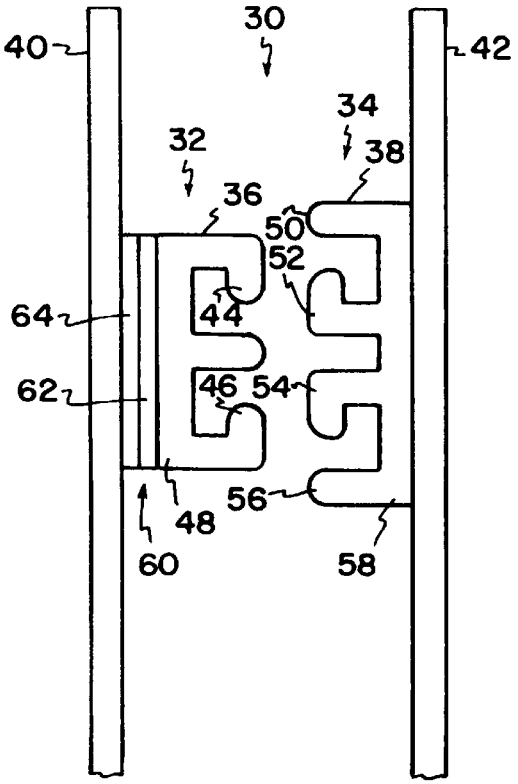
FIG. 2 is a fragmented, cross-sectional, schematic view of a closure mechanism, according to an example embodiment of the present invention.
Figure 3:
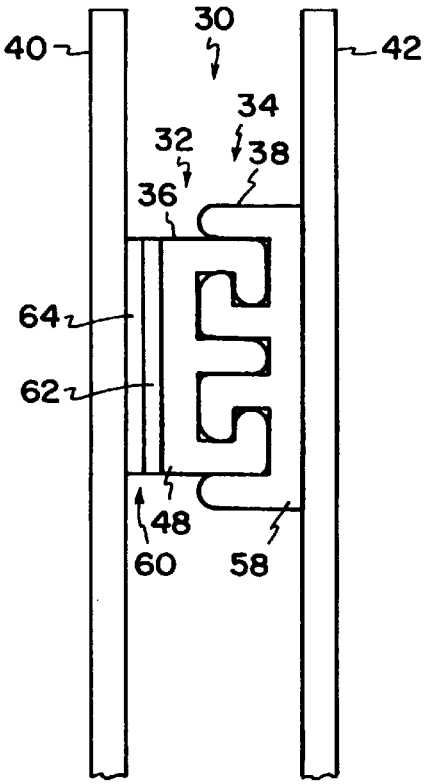
FIG. 3 is a fragmented, cross-sectional, schematic view of the closure mechanism illustrated in FIG. 2 and depicted in a mating or sealed orientation, according to an example embodiment of the present invention.

Attention is directed to FIGS. 2 and 3. In FIGS. 2 and 3, closure mechanism 30 is illustrated as having a first closure member 32 and an oppositely disposed second closure member 34. First closure member 32 includes a male closure profile 36, and second closure member 34 includes a female closure profile 38. Each of first closure member 32 and second closure member 34 is secured to a respective wall section 40, 42 of a flexible package. For example, wall section 40 may correspond to first panel section 14 (FIG. 1), while wall section 42 corresponds to second panel section 16 (FIG. 1).

Closure mechanism 30 illustrates a dual-track zipper. By "dual-track zipper", it is meant the first and second closure members 32, 34 have two tracks, typically one immediately adjacent to the next, which interlocks with its oppositely disposed profile member. For example, in FIG. 2, first closure member 32 comprises male profile 36 with first and second male members 44, 46 in extension from a base strip 48. The second closure member 34 comprises female closure profile 38 having a first pair of legs, 50, 52 for enclosing first male member 44, and a second pair of legs 54, 56 for enclosing and interlocking with second male member 46. Legs 50, 52, 54, 56 extend from a female base strip 58. The combination of first male member 44 and legs 50, 52 forms the first track of the dual track zipper arrangement. Analogously, the combination of second male member 46 and legs 54, 56 form the second track of the dual track closure mechanism 30.

FIG. 3 illustrates the closure mechanism 30 in a locked or sealed orientation. That is, male and female profiles 36, 38 are mated and interlocked with each other to prohibit access between male profile 36 and female profile 38. Arranged in a flexible package such as that illustrated at 10 in FIG. 1, the locked or sealed orientation of FIG. 3 will prevent access to package interior 20.

Closure mechanism 30 is constructed and arranged to prevent access to package interior 20 after being placed in its closed or sealed orientation, without providing an indication to a person that the closure mechanism 30 has already been sealed once. While a variety of working embodiments are contemplated herein, in FIGS. 2 and 3, closure mechanism 30, in general, is configured to be rendered inoperative after initial closing of the closure mechanism 30 and after access is gained to package interior 20. In other words, closure mechanism 30 is transformable from a lockable orientation (FIGS. 2 and 3) to an unlockable orientation (FIG. 4) by pulling the walls 40, 42 away from each other and peeling one of the first or second closure members 32, 34 away from its respective walls 40, 42, in order to gain access to the product side of the closure mechanism 30.

Specifically, closure mechanism 30 includes a peelable sealing arrangement securing one of the first or second closure members 32, 34 to its respective wall 40, 42. After initial interlocking of the male and female profiles 36,38, when a pulling force is exerted upon the closure mechanism 30, the closure mechanism 30 will peel or separate from one of the package walls, 40, 42 to provide access to the package interior 20.

In the particular embodiment illustrated in FIGS. 2 and 3, first closure member 32 is secured to wall 40 through a peelable sealing arrangement 60. Peelable sealing arrangement 60 includes a peelable sealant layer 62 for releasably adhering the first closure member 32 to the wall 40. The peelable sealing arrangement 60 may also include a bonding layer 64 for securing the peelable sealant layer 62 to the package wall 40.

The peelable sealant layer 62 is constructed and arranged to have a bond strength with the bonding layer 64 which is less than the bond strength between the interlocking male and female profiles 36, 38 (FIG. 3). In one preferred embodiment, the bond strength between peelable sealant layer 62 and bonding layer 64 is at least 25 percent less than the bonding strength between the interlocked male and female profiles 36, 38. In one embodiment, the bond strength between the peelable sealant layer 62 and bonding layer 64 is about 1.5 lbs./in., while the bond strength between the interlocked male and female profiles 36, 38 is about 2.0 lbs./in.

Peelable sealant layer 62 may be constructed from materials known to one skilled in the art. For example, peelable sealant layer 62 may be constructed from a blend of polyethylene and polybutylene. Peelable sealant layer 62 may also include blends of a mineral reinforcement concentrate and ethylene vinyl acetate (EVA) Usable compositions are described in U.S. Pat. No. 5,470,156, which patent is hereby incorporated by reference.

Bonding layer 64 may comprise a number of materials as known to one skilled in the art. For example, bonding layer 64 may typically be made from polyethylene, ethylene vinyl acetate (EVA), or blends thereof. Usable compositions are described in U.S. Pat. No. 5,470,156.

Figure 4:
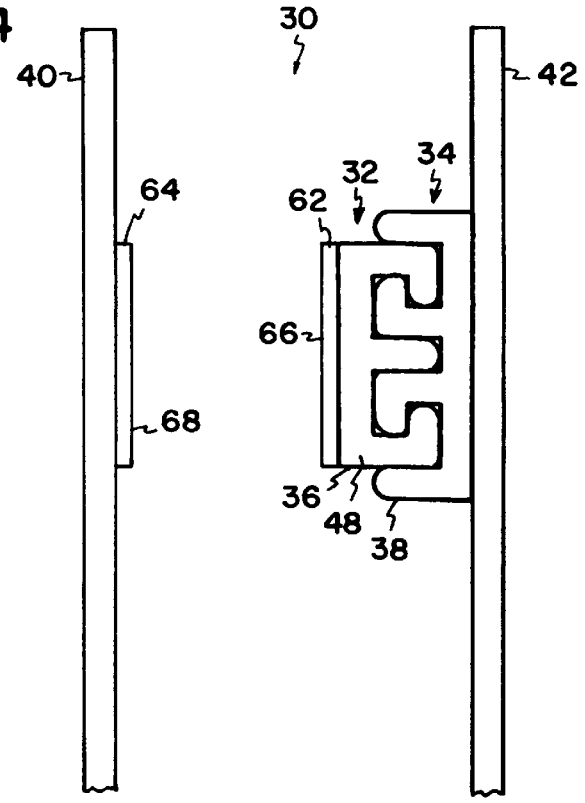
FIG. 4 is a fragmented, cross-sectional, schematic view of the closure mechanism depicted in FIGS. 2 and 3 and showing one of the closure members separated from a package wall, according to an example embodiment of the present invention.

FIG. 4 illustrates the closure mechanism 30 in an unlockable orientation. Specifically, the first closure member 32 is shown separated or peeled away from the package wall 40. More precisely, the peelable sealing arrangement 60 is shown split into two pieces, the peelable sealant layer 62 and the bonding layer 64. The peelable sealant layer 62 is still adhered to the base strip 48 of the first closure member 32, while the bonding layer 64 is adhered to the package wall 40. Note that the male profile 36 is interlocked and engaged with the female profile 38. This provides access to the package interior 20, while providing an indication that the package 10 has previously been sealed closed. It is not possible to again use the closure mechanism 30 to seal the package 10 closed, because the first closure member 32 has been separated from the wall 40.

The closure mechanism 30 is constructed and arranged to provide a visual indication that the closure mechanism 30 has already been sealed once and the package interior has been accessed. In the specific embodiment illustrated, closure mechanism 30 includes a color arrangement for providing this indication.

In particular, surface 66 of the peelable sealant layer 62 is pigmented a color which contrasts with a color of the remaining portions of the closure mechanism 30. Surface 66 is not visible when closure mechanism 30 is in its lockable orientation (FIGS. 2 and 3). Surface 66 only becomes visible when closure mechanism 30 is transformed to its unlockable orientation (FIG. 4). That is, surface 66 is only visible after being peeled away or separated from bonding layer 64. In this manner, a person inspecting a package including closure mechanism 30 will be able to readily detect if the package interior was accessed after the closure mechanism 30 was sealed in a closed position (FIG. 3). Colors for surface 66 can include any color which contrasts with the remaining portions of closure mechanism 30, such as red, yellow, or green.

Further, bonding layer 64 may also be pigmented at surface 68 to further enhance the ease of visibility to indicate that the package interior has been accessed after the closure mechanism 30 has been sealed.

In use, closure mechanism 30 operates in the following manner. A flexible package, such as package 10, will include closure mechanism 30 in an unlocked or unsealed orientation (FIG. 2). Items, such as groceries or other consumer products, will be placed into the package interior 20 through the mouth 28. The closure mechanism 30 will be sealed or closed by applying pressure to the male and female profiles 38, 38 in order to mate and interlock them. The closed orientation is shown in FIG. 3. The closed orientation prevents access to the interior 20 and the product side of the package 10. In order to gain access to the product side of the package 10 and to the items within the interior 20, the user grasps opposite wall sections 40, 42 and applies a pulling force in a direction outwardly from the closure mechanism 30. By applying the pulling force, the user will peel the fist closure member 32 away from wall section 40 (FIG. 4). Access is then permitted to the product side of the flexible package 10 due to the opening created between peelable sealant layer 62 and bonding layer 64. The color of surface 66 provides a visual indication to a person inspecting the package 10 that closure mechanism 30 was once sealed closed.

One example application of the embodiment of FIGS. 2–4 is in a department store. For example, after selling goods such as groceries, clothing, etc., the department store employee can quickly and manually (without tools) seal the sold products in a flexible bag or package. The customer can then be handed the bag with the purchased goods within it. If the customer inappropriately attempts to open the bag prior to leaving the store to place additional, unpurchased products within the bag interior, the bag will be damaged, through either torn bag side walls or through the broken peelable sealing arrangement 60 of the closure mechanism 30. Before each customer is allowed to exit the store, his or her package is inspected for damage of this type. For example, the inspection looks for the pigmented surface 66 of the sealant layer 62. If detected, the entire contents of the bag are inspected for evidence of purchase.

It should be noted that while the embodiment of FIGS. 2–4 show the first closure member 32 as being removably attached to the wall 40, in other arrangements, the second closure member 34 may be removably attached to the wall 42 with an analogous peelable sealing arrangement 60.

Figure 5:
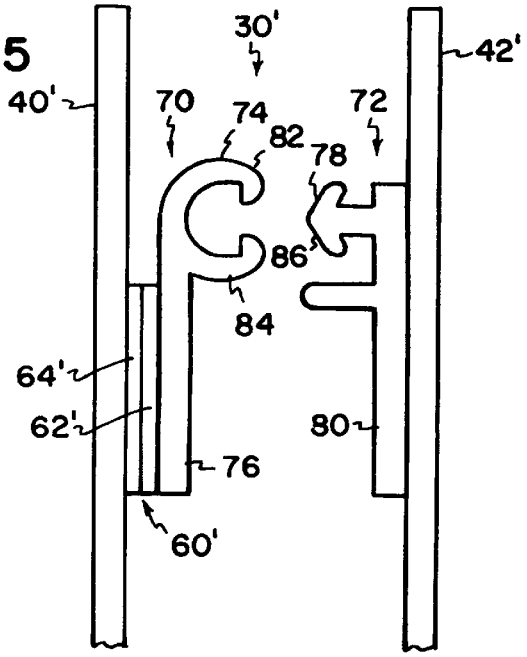
FIG. 5 is a fragmented, cross-sectional, schematic view of an alternate embodiment of the closure mechanism depicted in FIG. 2, according to an example embodiment of the present invention.

Attention is directed to FIG. 5. In FIG. 5, a modification of the closure arrangement of FIGS. 2–4 is shown generally as closure mechanism 30'. Closure mechanism 30' includes structure analogous to closure mechanism 30. Specifically, closure mechanism 30' includes a peelable sealing arrangement 60' having a peelable sealant layer 62' and bonding layer 64'. Closure arrangement 30' has first and second closure members 70, 72, as contrasted to 32, 34 in FIG. 2. First closure member 70 has a female closure profile 74 extending from a base strip or flange 76. Note that base flange 76 is secured to the wall 40' through the peelable sealing arrangement 60'. Note also that the female profile 74 is not attached to the wall 40'. That is, female profile 74 is spaced from and free from wall 40'. This arrangement of female profile 74 helps to ensure separation of the peelable sealing arrangement 60' between peelable sealant layer 62' and bonding layer 64'.

Second closure member 72 includes a male profile 78 extending from a flange 80. In this embodiment, closure mechanism 30' is a single-track zipper. By "single-track zipper", it is meant that the first and second closure members 70, 72 have a single track, as contrasted to two tracks and shown in FIGS. 2 and 3. For example, the combination of legs 82, 84 and male member 86 forms a single track for engagement. FIG. 5 shows the closure mechanism 30' in an open or unsealed orientation. Analogous to FIG. 3, the first and second closure members 70, 72 may be pressed together so that the male and female profiles 78, 74 interlock to seal the closure arrangement 30'.

As with the embodiment of FIGS. 2–4, after sealing the closure mechanism 30' in a closed orientation, access is blocked to the product side of the package until pealing the first closure member 70 away from the wall 40'. In this manner, it will be apparent to someone inspecting the package that the package was closed and then re-opened.

The closure mechanisms 30, 30' may be manufactured using conventional extrusion and heat sealing techniques. In particular, the base strip 48, the male profile 36, the peelable sealant layer 62, and the bonding layer 64 may be co-extruded through a single die plate fed by a plurality of extruders. These extruders carry the different molten materials for forming the male profile 36, the base strip 48, the peelable sealant layer 62, and the bonding layer 64. As is well known in the art, the die plate includes input ports, output ports, and channels connecting these input ports to output ports. The extruders feed the different molten materials to different input ports, and the channels are designed to configure the molten materials into the shapes of the closure profile 36, the base strip 48, the peelable sealant layer 62, and the bonding layer 64. In this process, the peelable sealant layer 62 is bonded to the base strip 48, and the bonding layer 64 is bonded to the peelable sealant layer 62. The strength of the bond between the peelable sealant layer 62 and bonding layer 64 depends upon the temperature and how long the layers are in contact under pressure. The die plate may be modified to achieve a weaker bond between the peelable sealant layer 62 and bonding layer 64 by shortening the distance and therefore the length of contact under pressure between the peelable sealant layer 62 and bonding layer 64. After co-extruding the first closure member and peelable sealing arrangement 60, the first closure member 32 maybe secured to the package wall 40 by heat sealing the bonding layer 64 to the film wall 40.

Second closure member 34 may be manufactured using a conventional extrusion and heat sealing technique. After extruding the second closure member 34, it may be secured to the film wall 42 by heat sealing, as is known in the art.

The above specification, examples and data provide a complete description of the manufacture and use of the invention. Many embodiments of the invention can be made without departing from the spirit and scope of the invention.

We claim:

1. A flexible package comprising:

(a) a first film wall;

(b) a second film wall opposed to and secured to said first film wall;

(i) said first and second walls defining an interior and a mouth; said mouth having an open position and a closed position; said open position providing access to said interior; said closed position blocking access to said interior; and (c) a closure arrangement for moving said mouth from said open position to said closed position; said closure arrangement having a lockable orientation and an unlockable orientation;

(i) said lockable orientation including:

(A) a first closure member secured to said first wall with a peelable sealing arrangement; said first closure member including a first profile;

(B) a second closure member secured to said second wall; said second closure member including a second profile; said first and second profiles being constructed and arranged to selectively interlock;

(ii) said unlockable orientation including:

(A) said first closure member being separated from said first wall; and (iii) said closure arrangement being transformed from said lockable orientation to said unlockable orientation responsive to a pulling force peeling said first closure member from said first wall.

2. A flexible package according to claim 1 wherein:

(a) said peelable sealing arrangement includes a peelable sealant layer; said peelable sealant layer being a color contrasting with other portions of the closure arrangement.

3. A flexible package according to claim 2 wherein:

(a) said peelable sealing arrangement includes a bonding layer securing said peelable sealant layer to said first wall.

4. A flexible package according to claim 3 wherein:

(a) said peelable sealant layer comprises a polyethylene and polybutylene blend.

5. A flexible package according to claim 4 wherein:

(a) said bonding layer comprises polyethylene.

6. A flexible package according to claim 3 wherein:

(a) said first profile includes dual tracks; and (b) said second profile includes dual tracks.

7. A flexible package according to claim 3 wherein:

(a) said first profile includes a single track; and (b) said second profile includes a single track.

8. A flexible package according to claim 7 wherein:

(a) said first closure member includes a first base flange extending from said first profile;

(i) said first closure member being secured to said peelable seal arrangement at only said first base flange; and (ii) said first profile being unattached to said peelable seal arrangement and said first wall.

9. A flexible package according to claim 8 wherein:

(a) said second closure member is heat sealed to said second wall.

10. A flexible package according to claim 9 wherein:

(a) said bonding layer is heat sealed to said first wall.

11. A flexible package according to claim 1 wherein:

(a) said first and second wall are secured by first and second, opposite side seals, and a bottom seal; said bottom seal being at an opposite end of said mouth.

12. A method of constructing a flexible package; the method comprising steps of:

(a) providing a first film wall;

(b) providing a second film wall;

(c) securing with a peelable sealant arrangement a first closure member to the first wall; the first closure member including a first profile;

(d) securing a second closure member to the second wall; the second closure member including a second profile; the first and second profiles being constructed and arranged to selectively interlock with a first bond strength; and (i) said step of securing with a peelable sealant arrangement includes securing the first closure member with a peelable seal layer having a second bond strength less than the first bond strength between the interlocking first and second profiles.

13. A method of constructing a flexible package according to claim 12 wherein:

(a) said step of securing with a peelable sealant arrangement includes securing the peelable seal layer to the first wall with a bonding layer.

14. A method of constructing a flexible package according to claim 13 wherein:

(a) said step of securing a second closure member includes heat sealing the second closure member to the second wall.

15. A method of constructing a flexible package according to claim 14 wherein:

(a) said step of securing with a peelable sealant arrangement includes securing a base flange of the first closure member to the first wall with the peelable sealant arrangement, and providing no attachment between the first profile and the first wall.

16. A method for using a flexible package; the method comprising steps of:

(a) providing a flexible package having an interior, a mouth providing access to the interior, and a closure arrangement; the closure arrangement including a first closure member secured to a first wall of the flexible package, and a second closure member secured to an opposite, second wall of the flexible package;

(b) sealing the mouth in a closed position to block access to the interior by interlocking the first and second closure members; and (c) accessing the package interior by peeling the first closure member away from the first wall.

17. A method for using a flexible package according to claim 16 wherein:

(a) said step of accessing the package interior includes peeling a peelable seal layer secured to the first closure member from a bonding layer secured to first wall.

18. A method for using a flexible package according to claim 17 wherein:

(a) said step of peeling the first closure member from the first wall includes pulling the first and second walls apart.

19. A method for using a flexible package according to claim 18 further including:

(a) after said step of accessing the package interior, viewing a contrasting color on the peelable sealant layer.

20. A method for using a flexible package according to claim 19 further including:

(a) after said step of viewing, discarding the package.

* * * * *